US011596185B2

(12) United States Patent
Stein

(10) Patent No.: US 11,596,185 B2
(45) Date of Patent: Mar. 7, 2023

(54) GARMENT WITH BUILT-IN STRETCH BRALETTE

(71) Applicant: The Rolling Steins, LLC, Fort Lauderdale, FL (US)

(72) Inventor: Michelle Stein, Fort Lauderdale, FL (US)

(73) Assignee: The Rolling Steins, Fort Lauderdale, FL (US)

( * ) Notice: Subject to any disclaimer, the term of this patent is extended or adjusted under 35 U.S.C. 154(b) by 173 days.

(21) Appl. No.: 17/249,220

(22) Filed: Feb. 24, 2021

(65) Prior Publication Data

US 2022/0264963 A1 Aug. 25, 2022

(51) Int. Cl.
*A41C 3/08* (2006.01)
*A41C 3/12* (2006.01)
*A41F 15/00* (2006.01)

(52) U.S. Cl.
CPC ..... *A41C 3/08* (2013.01); *A41C 3/128* (2013.01); *A41F 15/00* (2013.01)

(58) Field of Classification Search
CPC ..... A41C 3/08; A41C 3/128; A41F 5/00
USPC ..... 450/11, 30–33
See application file for complete search history.

(56) References Cited

U.S. PATENT DOCUMENTS 1,990,322 A 2/1935 Goldberg
2,863,460 A * 12/1958 Monroe ..... A41C 3/08 450/55
4,372,320 A 2/1983 Silber
6,434,751 B1 * 8/2002 Gustafson ..... A41D 1/18 2/400
6,811,462 B1 11/2004 Kenneally
7,201,629 B2 * 4/2007 Lambru ..... A41C 3/005 2/310
7,306,505 B2 * 12/2007 Barbour ..... A41C 3/0057 450/23
7,488,234 B2 2/2009 Rothman
7,628,675 B2 * 12/2009 Staub ..... A41C 3/0057 450/32
9,113,660 B2 * 8/2015 Op't Hof ..... A41B 9/06
D790,802 S * 7/2017 Op't Hof ..... D2/703
D791,438 S 7/2017 Holmes
10,645,979 B2 5/2020 Zhu
2001/0000164 A1 4/2001 Heroff
2009/0265830 A1 * 10/2009 Hendrickson ..... A41D 1/215 2/104
2010/0011481 A1 1/2010 Kipnes
2014/0099864 A1 4/2014 Moulden et al.
2014/0273737 A1 9/2014 Cortese et al.
2016/0050983 A1 2/2016 Ichiba et al.
2018/0092408 A1 4/2018 Hensel
2019/0274370 A1 9/2019 Zhu

OTHER PUBLICATIONS

"Fold Over Elastic and How to Use It" (Johnson) Apr. 21, 2019 (Apr. 21, 2019) [online] retrieved from, URL: https//ww.barandcorsetsupplies.com/2019/04/21/fold-over-elastic-and-how-to-use=it/, entire document, esepecialloy p. 1 in 3-6.

* cited by examiner

*Primary Examiner* — Gloria M Hale
(74) *Attorney, Agent, or Firm* — Sagacity Legal, PLLC

(57) ABSTRACT

A garment with a built-in stretch bralette comprises an outer garment and the built-in stretch bralette, wherein the built-in stretch bralette is attached to the outer garment using intermittently secured attachment means.

18 Claims, 10 Drawing Sheets

GARMENT WITH BUILT-IN STRETCH BRALETTE

BACKGROUND OF THE INVENTION

A brassiere ("bra") is a piece of clothing that is worn by women under other clothes (also referred to as garments) to cover and support the breasts. A bralette is an unlined bra without underwires or a clasp. For many women, wearing a camisole, tank top, dress, nightgown and other similar loungewear made of lightweight silk, satin or similar thin, clinging, non or minimally stretchable fabric without also wearing a bra (for example, a bralette) feels uncomfortable both physically and emotionally. Due to the clinging fit of such garments, not wearing a bra may look unflattering. However, wearing a bra under such garments may be unsightly. For example, a bra may be bulky or its straps may show outside of the garment.

Some garments are known to incorporate an integral bra. An integral bra is a type of bra that supports the lower part of the breasts, equipped with an elastic band at the base to lift breasts up. When today's integral bras are attached to certain non or minimally stretchable materials, the attachment causes pulling of the material, for example at the top of the bra, thereby causing an overall unattractive look.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
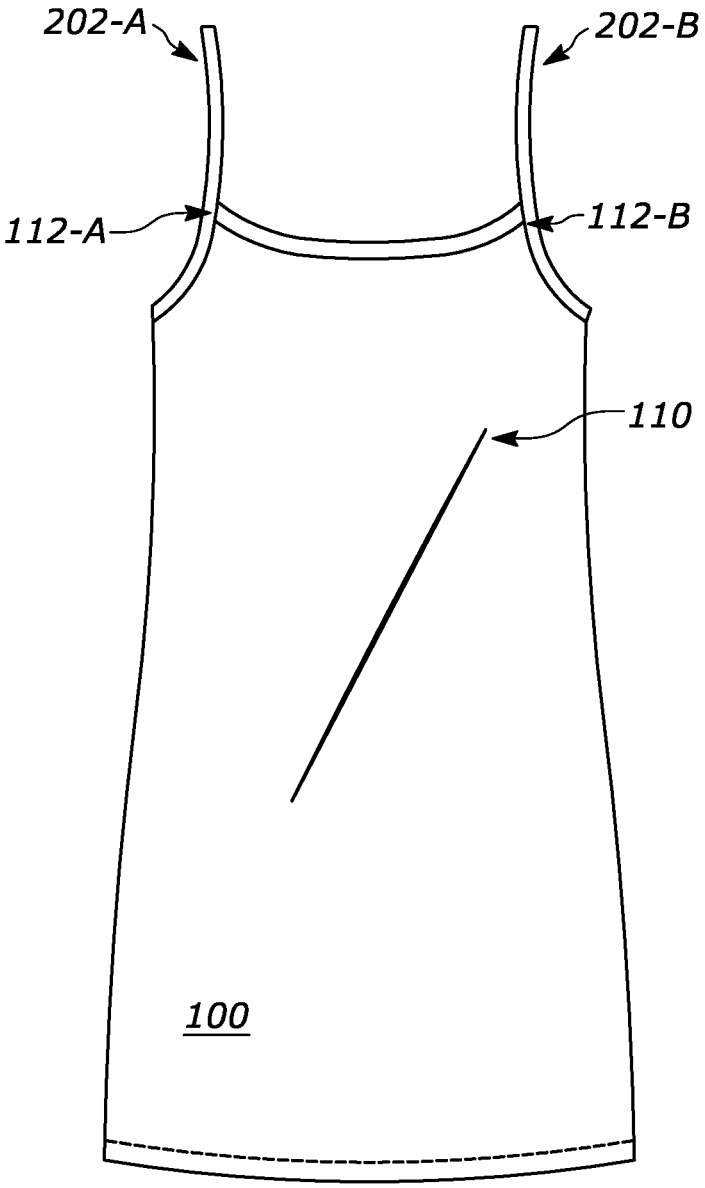
FIG. 1 illustrates a front view of a garment for use in the implementation of some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

A garment with a built-in stretch bralette comprises an outer garment; and the built-in stretch bralette, wherein the built-in stretch bralette is attached to the outer garment using intermittently secured attachment means.

FIG. 1 illustrates a front view of a garment for use in the implementation of some embodiments. The garment includes an outer garment 100, which, for example, may be a camisole, tank top, dress, nightgown, or other similar loungewear. It will be appreciated that the outer garment 100 is simply an illustrative example for clarity of description and that the present invention may be implemented within alternative outer garments now known or later developed other than illustrated or described herein. The outer garment 100, simply for exemplary purposes, is illustrated as a tank style dress. As will be described hereinafter, it will be appreciated that the present invention can be implemented with any style garment. The outer garment 100 may be made of lightweight silk, satin or similar thin, clinging, non or minimally stretchable fabric. It will be appreciated that the outer garment 100, in alternative embodiments, may be made of any similar material now known or later developed.

Figure 2:
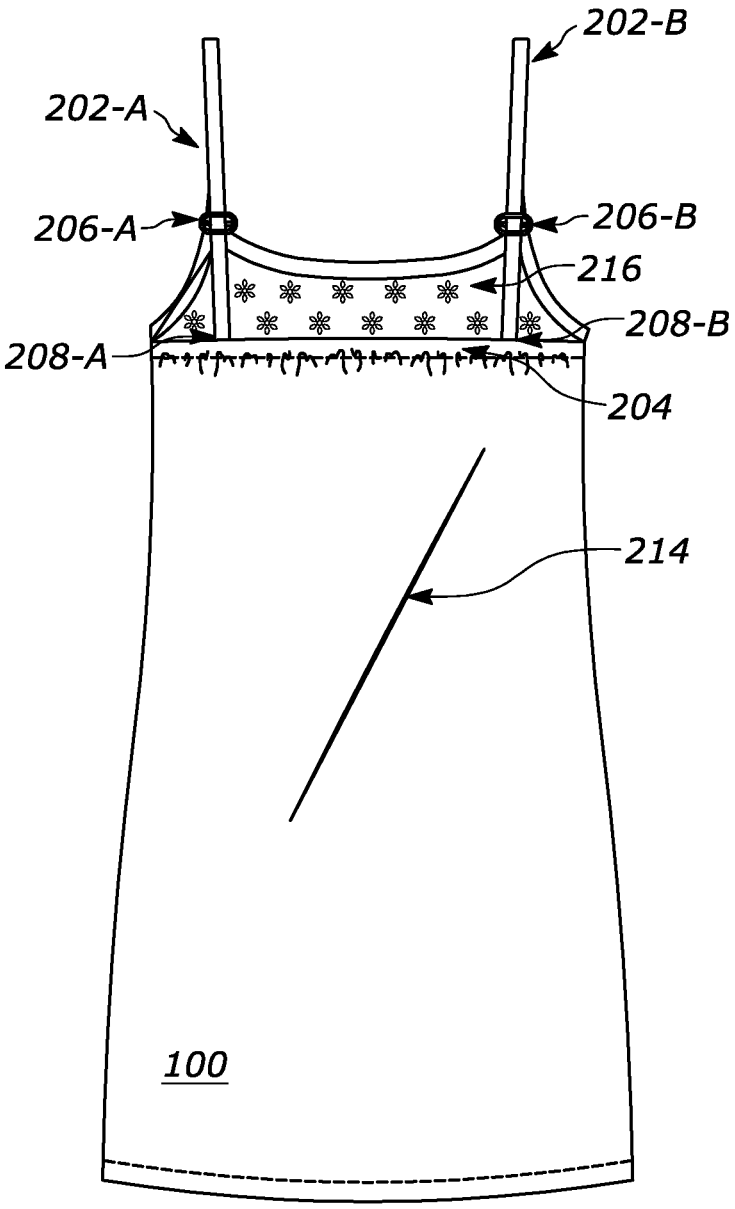
FIG. 2 illustrates a back view of a garment with a built-in stretch bralette in accordance with some embodiments.

FIG. 2 illustrates a back view of the garment of FIG. 1 in accordance with some embodiments. The garment, simply for exemplary purposes, is illustrated as a tank style dress.

The outer garment 100 includes two shoulder straps 202-A and 202-B. When the garment is worn, each shoulder strap 202 passes across one or both of the shoulders and attaches to a back band 204 of a back 214 of the outer garment 100 to support the outer garment 100. It will be appreciated that although two shoulder straps 202 are illustrated, any number of shoulder straps may be implemented in accordance with various embodiments. The shoulder straps 202, in some embodiments are made of the same material as the outer garment 100. Alternatively, the shoulder straps 202 may be made of another material, now known or later developed. In some embodiments, proximately located with and coupled to each shoulder strap 202 is a slider 206. As illustrated, for example, the slider 206-A is proximately located with and coupled to the shoulder strap 202-A and the slider 206-B is proximately located with the shoulder strap 202-B. Each slider 206 enables adjustment of the length of the associated shoulder strap 202. As is known in the art, each slider 206 may be a ring, slide, hook, or other similar mechanically adjusting apparatus. In some embodiments, each slider 206 is made of stainless steel or other similar metal, or alternatively made of plastic and nylon coated metal and stainless steel. It will be appreciated that any adjusting apparatus of any appropriate material now known or future developed may be used for each of the sliders 206. In alternative embodiments, the outer garment 100 does not include a slider.

As previously mentioned, each shoulder strap 202 attaches to the back band 204 of the back 214 of the outer garment 100 via a back securing means 208. For example, as illustrated the shoulder strap 202-A attaches to the back band 204 of the outer garment 100 via the back securing means 208-A. Similarly, the shoulder strap 202-B attaches to the back band 204 of the outer garment 100 via the back securing means 208-B. It will be appreciated by those of ordinary skill in the art that in one embodiment one or more of the back securing means 208 comprises a permanent attachment such as a sewn, stapled, mechanically attached (for example via a ring) or other permanent attachment. It will further be appreciated that in alternative embodiments one or more of the back securing means 208 comprises a removable attachment such as a VELCRO® for e.g., self-fasteners, hook and loop, closures, and the like, snap, button, or other removable attachment.

Referring back to FIG. 1, it will be appreciated by those of ordinary skill in the art that each shoulder strap 202 further attaches to a front 110 of the outer garment 100 via a front securing means 112. For example, as illustrated the shoulder strap 202-A attaches to the front 110 of the outer garment 100 via the front securing means 112-A. Similarly, the shoulder strap 202-B attaches to the front 110 of the outer garment 100 via the front securing means 112-B. It will be appreciated by those of ordinary skill in the art that in one embodiment one or more of the front securing means 112 comprises a permanent attachment such as a sewn, stapled, mechanically attached (for example via a ring) or other permanent attachment. It will further be appreciated that in alternative embodiments one or more of the front securing means 112 comprises a removable attachment such as a VELCRO®, snap, button, or other removable attachment.

Returning to FIG. 2, in some embodiments, the back band 204 is finished or bound with the same or similar material as the outer garment 100. Alternatively, the back band 204 is finished using elastic covered by a finishing material, which may, in some embodiments, match the material of the outer garment 100. The elastic may be, for example, braided, woven, knitted, or any other elastication means now known or later developed. In alternative embodiments, the back band 204 of the outer garment 100 does not include elastication means.

The built-in stretch bralette 216, in accordance with some embodiments, is composed of stretch lace or a similar stretch fabric. Lace is a delicate fabric made of yarn or thread in an open weblike pattern, made by machine or by hand. Stretch fabrics include, but are not limited to, elastane, nylon and elastane combinations, and polyester and elastane combinations.

Figure 3:
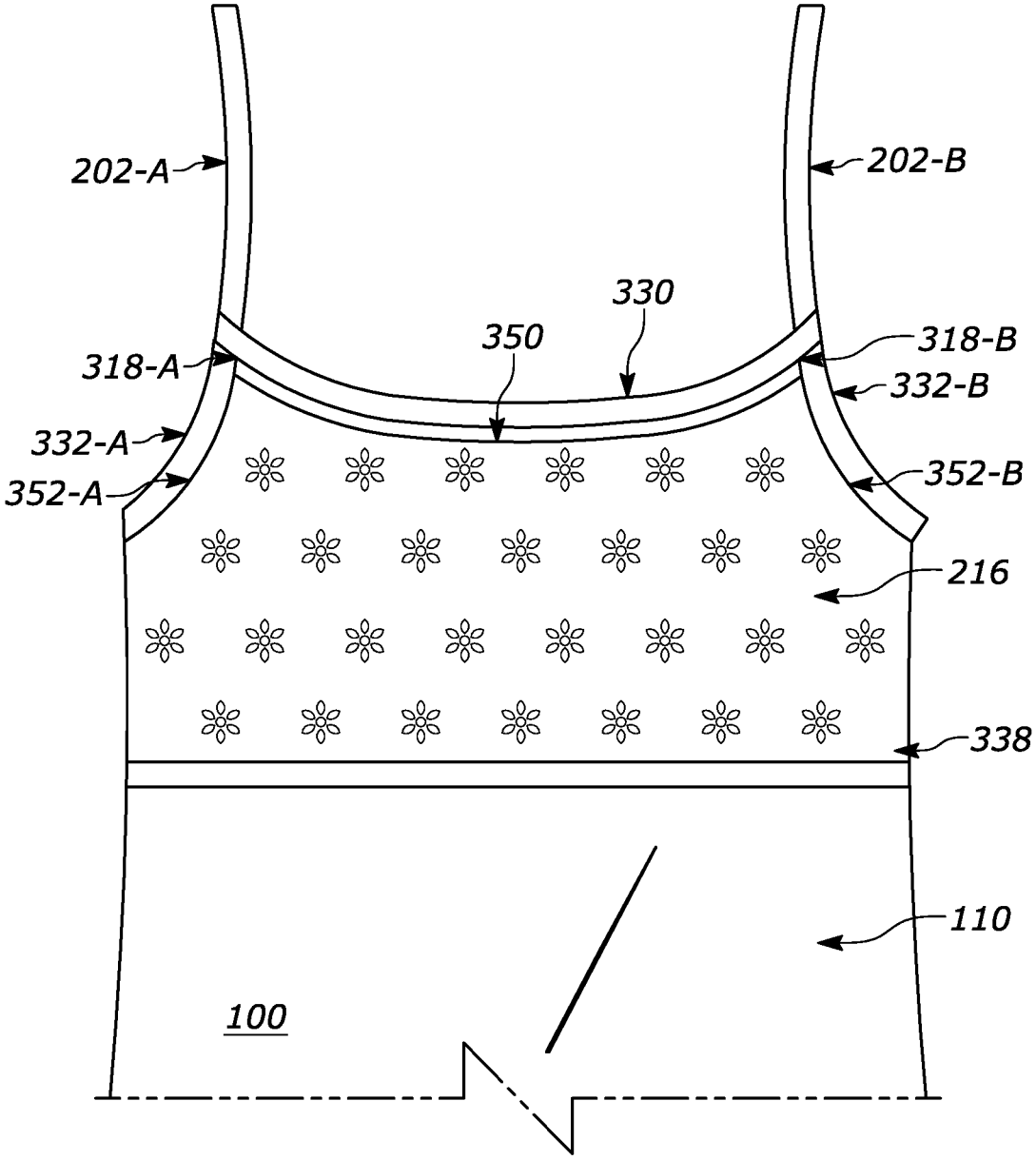
FIG. 3 illustrates an inside view of a garment with a built-in stretch bralette in accordance with some embodiments.

Referring to FIG. 3, an inside view of the garment of FIGS. 1 and 2 is illustrated in accordance with some embodiments. As illustrated, the built-in stretch bralette 216, in accordance with some embodiments, has a bralette neckline 350 proximately located in parallel to a neckline 330 of the outer garment 100. Further, the built-in stretch bralette 216, in accordance with some embodiments, has two bralette armholes 352 proximately located in parallel to each of the armholes 332 of the outer garment 100. For example, the bralette armhole 352-A is located parallel to the armhole 332-A of the outer garment 100; and the bralette armhole 352-B is located parallel to the armhole 332-B of the outer garment 100.

The built-in stretch bralette 216, in accordance with some embodiments, is attached to the outer garment 100 using intermittently secured attachment means. The intermittent securing of the built-in stretch bralette 216 allows it to be supportive while not sticking out under the shoulder straps 202. It will be appreciated by those of ordinary skill in the art that in one embodiment the built-in stretch bralette 216 is permanently attached intermittently to the outer garment 100 such as a sewn, stapled, or other permanent attachment. It will further be appreciated that in alternative embodiments the built-in stretch bralette 216 is intermittently removably attached to the outer garment 100 using VELCRO®, snap, button, or other removable attachment.

In some embodiments, the built-in stretch bralette 216 is attached at a front base 318 of each of the shoulder straps 202, leaving a gap at a neckline 330 and at each armhole 332 (332-A and 332-B). In some embodiments, the built-in stretch bralette 216 includes a finishing at portions that are not attached to the outer garment 100, for example, at the locations of each of the gaps. In some embodiments, the bralette neckline 350 and each of the bralette armholes 352 (352-A and 352-B) is finished or bound with the same or similar material as the outer garment 100. Alternatively, the bralette neckline 350 and each of the bralette armholes 352 (352-A and 352-B) is finished using a foldover elastic, which may, in some embodiments, match the material of the outer garment 100. The elastic may be, for example, braided, woven, knitted, or any other elastication means now known or later developed.

As illustrated, the built-in stretch bralette 216 is attached at a front base 318-A of the shoulder strap 202-A, and is attached at a front base 318-B of the shoulder strap 202-B. In one embodiment, the built-in stretch bralette 216 is attached solely at the front base 318 of each the shoulder straps 202. In another embodiment, the built-in stretch bralette 216 is further attached to the entire back band 204 of the outer garment 100 (not illustrated). In yet another embodiment, the built-in stretch bralette 216 is also attached proximately to the location of the back securing means 208 (see FIG. 2) of each shoulder strap at the back band 204 of the outer garment 100 (not illustrated). For example, the built-in stretch bralette 216 may be also attached proximately to the location of the back securing means 208-A (see FIG. 2) of the shoulder strap 202-A and also attached proximately to the location of the back securing means 208-B (see FIG. 2) of the shoulder strap 202-B. Each embodiment herein described of the intermittently secured attachment of the built-in stretch bralette 216 to the outer garment 100 eliminates the pulling that would otherwise happen when a stretchable material in a bralette is attached to a non-stretchable silk.

In some embodiments, the built-in stretch bralette 216 is further attached continuously at a bralette front bottom portion around the front 110 of the outer garment 100. The front 110 of the outer garment 100, at the bralette front bottom portion 338, in some embodiments, is finished or bound with the same or similar material as the outer garment 100. Alternatively, the front 110 of the outer garment 100, at the bralette front bottom portion 338 is finished using elastic covered by a finishing material, which may, in some embodiments, match the material of the outer garment 100. The elastic may be, for example, braided, woven, knitted, or any other elastication means now known or later developed. In alternative embodiments, the front 110 of the outer garment 100 does not include elastication means.

Figure 4:
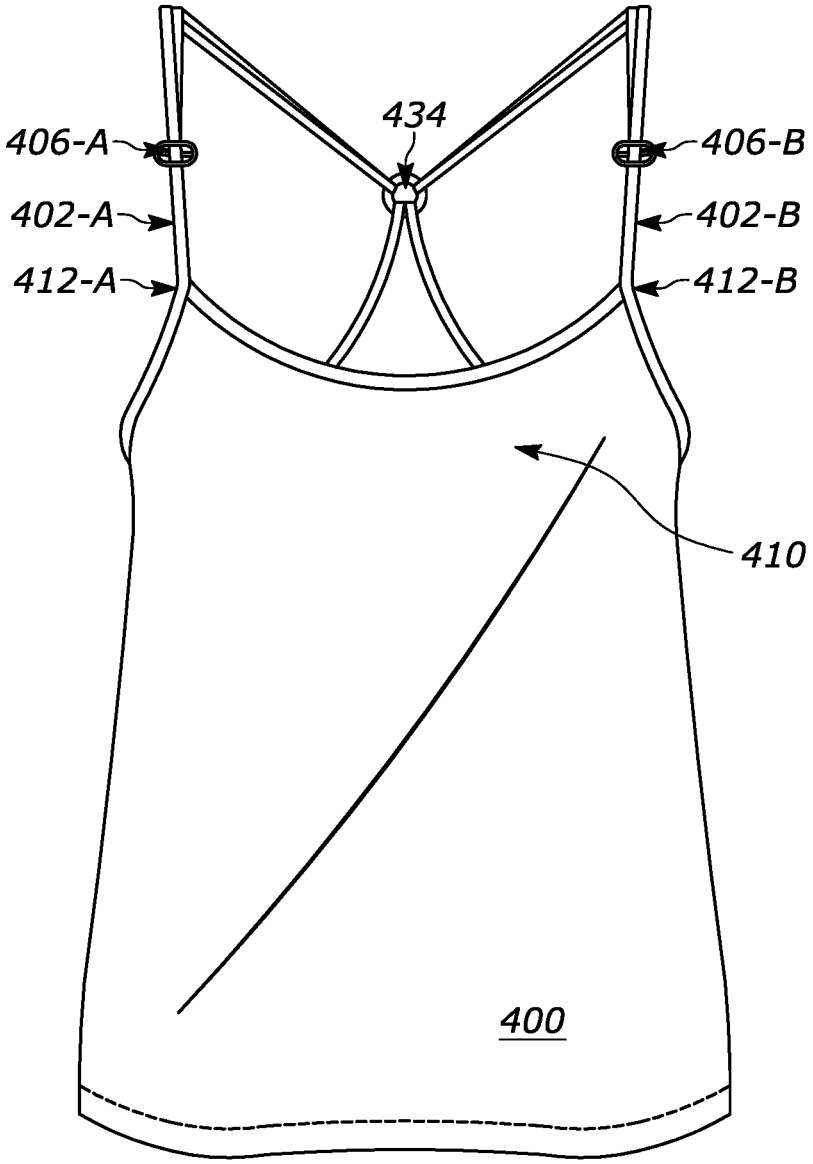
FIG. 4 illustrates a front view of a garment with a built-in stretch bra in accordance with a first alternative embodiment.

FIG. 4 illustrates a front view of a racerback garment with a built-in stretch bralette in accordance with a first alternative for use in the implementation of some embodiments. The garment includes a racerback outer garment 400, which, for example, may be a camisole, tank top, dress, nightgown, or other similar loungewear. It will be appreciated that the racerback outer garment 400 is simply an illustrative example for clarity of description and that the present invention may be implemented within alternative garments now known or later developed other than illustrated or described herein. The racerback outer garment 400 comprises a racerback camisole with a built-in stretch bralette. The term racerback refers to a design with a "Y" or "V" shape back design. The racerback outer garment 400 may be made of lightweight silk, satin or similar thin, clinging, non or minimally stretchable fabric. It will be appreciated that the racerback outer garment 400, in alternative embodiments, may be made of any similar material now known or later developed.

The racerback outer garment 400 includes two racerback shoulder straps 402-A and 402-B. It will be appreciated that although two racerback shoulder straps 402 are illustrated, any number of shoulder straps may be implemented in accordance with various embodiments. The racerback shoulder straps 402, in some embodiments, are made of the same material as the racerback outer garment 400. Alternatively, the racerback shoulder straps 402 may be made of another material, now known or later developed. In some embodiments, proximately located with and coupled to each racerback shoulder strap 402 is a racerback slider 406. As illustrated, for example, the racerback slider 406-A is proximately located with and coupled to the racerback shoulder strap 402-A and the racerback slider 406-B is proximately located with the racerback shoulder strap 402-B. Each racerback slider 406 enables adjustment of the length of the associated racerback shoulder strap 402. As is known in the art, each racerback slider 406 may be a ring, slide, hook, or other similar mechanically adjusting apparatus. In some embodiments, each racerback slider 406 is made of stainless steel or other similar metal, or alternatively made of plastic and nylon coated metal and stainless steel. It will be appreciated that any adjusting apparatus of any appropriate material now known or future developed may be used for each of the racerback sliders 406. In alternative embodiments, the racerback outer garment 400 does not include a slider.

Each racerback shoulder strap 402 is attached to a racerback front 410 of the racerback outer garment 400 via a racerback front securing means 412. For example, as illustrated the racerback shoulder strap 402-A attaches to the racerback front 410 of the racerback outer garment 400 via the racerback front securing means 412-A. Similarly, the racerback shoulder strap 402-B attaches to the racerback front 410 of the racerback outer garment 400 via the racerback front securing means 412-B. It will be appreciated by those of ordinary skill in the art that in one embodiment one or more of the racerback front securing means 412 comprises a permanent attachment such as a sewn, stapled, mechanically attached (for example via a ring) or other permanent attachment. It will further be appreciated that in alternative embodiments one or more of the racerback front securing means 412 comprises a removable attachment such as a VELCRO®, snap, button, or other removable attachment.

When the garment is worn, each racerback shoulder strap 402 passes across one or both of the shoulders and crisscrosses each other at a crossing point 434. It will be appreciated that the crossing point 434 may be a ring or other similar mechanically coupling apparatus. In some embodiments, the crossing point 434 is made of stainless steel or other similar metal, or alternatively made of plastic and nylon coated metal and stainless steel. It will be appreciated that any coupling apparatus of any appropriate material now known or future developed may be used for each of the crossing point 434. In alternative embodiments, the crossing point 434 permanently attaches the racerback shoulder strap 402-A to the racerback shoulder strap 402-B such as using a sewn, stapled, or other permanent attachment. It will further be appreciated that in alternative embodiments the crossing point 434 removably attaches the racerback shoulder strap 402-A to the racerback shoulder strap 402-B using VELCRO®, snap, button, or other removable attachment.

Figure 5:
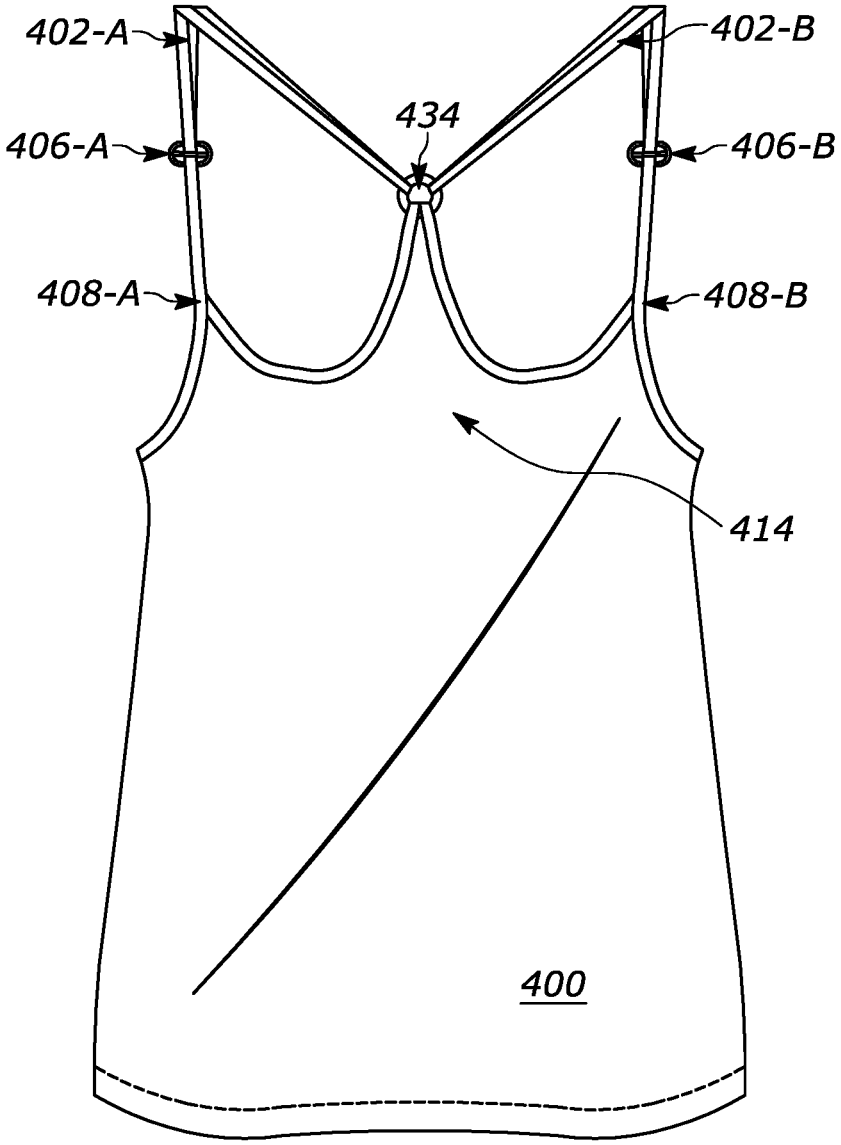
FIG. 5 illustrates a back view of a garment with a built-in stretch bralette in accordance with a first alternative embodiment.

FIG. 5 illustrates a back view of the racerback garment of FIG. 4. As illustrated, after crossing at the crossing point 434, each racerback shoulder strap 402 becomes integrated with a racerback back 414 of the racerback outer garment 400. In some embodiments, the racerback shoulder strap 402-A and the racerback shoulder strap 402-B attach to the racerback back 414 of the racerback outer garment 400 via one shared racerback back securing means. In alternative embodiments, the racerback shoulder strap 402-A and the racerback shoulder strap 402-B attach to the racerback back 414 of the racerback outer garment 400 via different individual racerback back securing means (not illustrated). It will be appreciated by those of ordinary skill in the art that in one embodiment one or more of the racerback back securing means comprises a permanent attachment such as a sewn, stapled, mechanically attached (for example via a ring) or other permanent attachment. It will further be appreciated that in alternative embodiments one or more of the racerback back securing means comprises a removable attachment such as a VELCRO®, snap, button, or other removable attachment.

Figure 6:
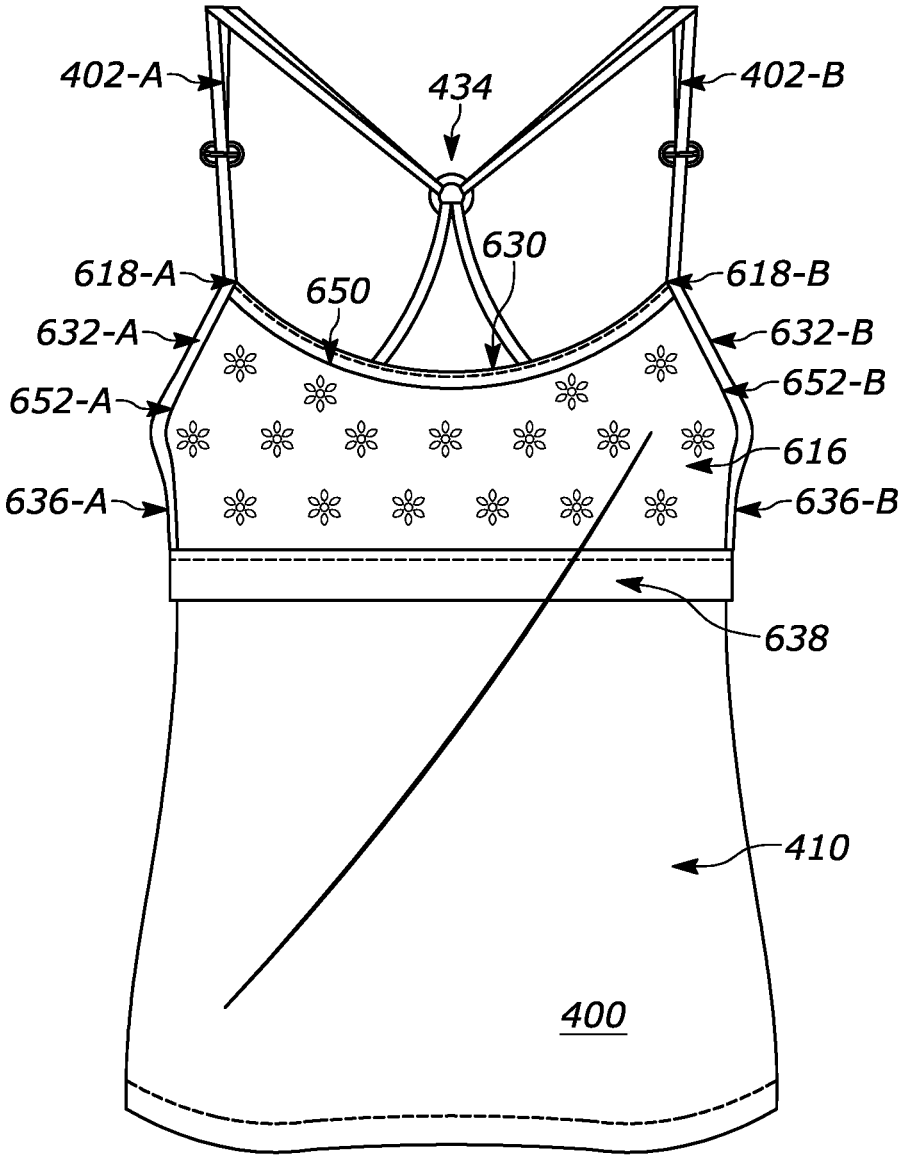
FIG. 6 illustrates an inside view of a garment with a built-in stretch bralette in accordance with a first alternative embodiment.

FIG. 6 illustrates an inside view of the racerback garment of FIGS. 4 and 5. Specifically, FIG. 6 illustrates an inside view of the racerback front 410 of the racerback garment.

A racerback built-in stretch bralette 616, in accordance with some embodiments, is composed of stretch lace or a similar stretch fabric. Lace is a delicate fabric made of yarn or thread in an open weblike pattern, made by machine or by hand. Stretch fabrics include, but are not limited to, elastane, nylon and elastane combinations, and polyester and elastane combinations.

As illustrated, the racerback built-in stretch bralette 616, in accordance with some embodiments, has a racerback bralette neckline 650 proximately located in parallel to a racerback neckline 630 of the racerback outer garment 400. Further, the built-in stretch bralette 616, in accordance with some embodiments, has two racerback bralette armholes 652 proximately located in parallel to each of the racerback armholes 632 of the racerback outer garment 400. For example, the racerback bralette armhole 652-A is located parallel to the racerback armhole 332-A of the racerback outer garment 400; and the racerback bralette armhole 652-B is located parallel to the racerback armhole 632-B of the racerback outer garment 400.

The racerback built-in stretch bralette 616, in accordance with some embodiments, is attached to the racerback outer garment 400 using intermittently secured attachment means. The intermittent securing of the racerback built-in stretch bralette 616 allows it to be supportive while not sticking out under the racerback shoulder straps 402. It will be appreciated by those of ordinary skill in the art that in one embodiment the racerback built-in stretch bralette 616 is permanently attached such as a sewn, stapled, or other permanent attachment. It will further be appreciated that in alternative embodiments the racerback built-in stretch bralette 616 is removably attached using VELCRO®, snap, button, or other removable attachment.

In some embodiments, the racerback built-in stretch bralette 616 is attached at a racerback front base 618 of each of the racerback shoulder straps 402; and further attached at a racerback side seam 636 of each side of the racerback front 410, leaving a gap at a racerback neckline 630 and at each racerback armhole 632 (632-A and 632-B). The racerback front base 618, for example, may be the same or proximately located to the racerback front securing means 412 of FIG. 4. The racerback side seam 636, for example, may be the same or proximately located to the racerback back securing means 408 of FIG. 5. In some embodiments, the racerback built-in stretch bralette 616 is further attached to the racerback back 414 either continuously or intermittently (not illustrated). In alternative embodiments, the racerback built-in stretch bralette 616 is independent and not attached to the racerback back 414. (not illustrated)

In some embodiments, the racerback built-in stretch bralette 616 includes a finishing at portions that are not attached to the racerback outer garment 400, for example, at the locations of each of the gaps. In some embodiments, the racerback bralette neckline 650 and each of the racerback bralette armholes 652 (652-A and 652-B) is finished or bound with the same or similar material as the racerback outer garment 400. Alternatively, the racerback bralette neckline 650 and each of the racerback bralette armholes 652 (652-A and 652-B) is finished using a foldover elastic, which may, in some embodiments, match the material of the racerback outer garment 400. The elastic may be, for example, braided, woven, knitted, or any other elastication means now known or later developed.

As illustrated, the racerback built-in stretch bralette 616 is attached at a racerback front base 618-A of the racerback shoulder strap 402-A, and is attached at a racerback front base 618-B of the racerback shoulder strap 402-B. The racerback built-in stretch bralette 616 is further attached at a racerback side seam 636-A and a racerback side seam 636-B. Taken together, the attachment mechanism leaves a first gap at the racerback neckline 630, a second gap at a first racerback armhole 632-A and a third gap at a second racerback armhole 632-B.

Each embodiment herein described of the intermittently secured attachment of the racerback built-in stretch bralette 616 to the racerback outer garment 400 eliminates the pulling that would otherwise happen when a stretchable material in a bralette is attached to a non-stretchable silk.

In another embodiment, the racerback built-in stretch bralette 616 is further attached continuously at a bralette front bottom portion 638 around the racerback front 410 of the racerback outer garment 400. The racerback front 410 of the racerback outer garment 400, at the bralette front bottom portion 638, in some embodiments, is finished or bound with the same or similar material as the racerback outer garment 400. Alternatively, the racerback front 410 of the racerback outer garment 400, at the bralette front bottom portion 638 is finished using elastic covered by a finishing material, which may, in some embodiments, match the material of the racerback outer garment 400. The elastic may be, for example, braided, woven, knitted, or any other elastication means now known or later developed. In alternative embodiments, the racerback front 410 of the racerback outer garment 400 does not include elastication means.

Figure 7:
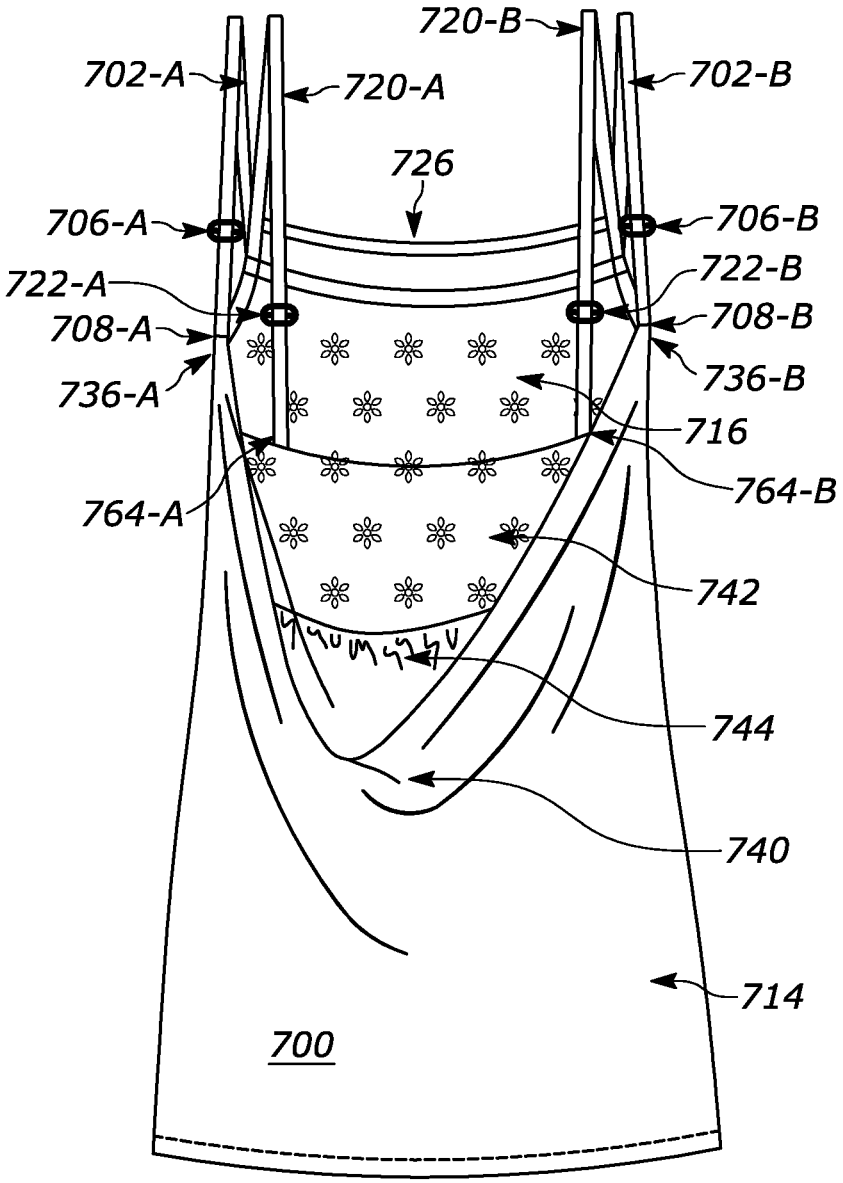
FIG. 7 illustrates a back view of a garment with a built-in stretch bralette in accordance with a second alternative embodiment.

FIG. 7 illustrates a back view of a back cowl neck garment with a built-in stretch bralette in accordance with a second alternative embodiment. The back cowl neck garment includes a back cowl neck outer garment 700, which, for example, may be a camisole, tank top, dress, nightgown, or other similar loungewear. It will be appreciated that the back cowl neck outer garment 700 is simply an illustrative example for clarity of description and that the present invention may be implemented within alternative garments now known or later developed other than illustrated or described herein. The back cowl neck outer garment 700 comprises a back cowl neck dress with a built-in stretch bralette. The term cowl neck refers to a design with a neckline on that hangs in draped folds. The back cowl neck outer garment 700 may be made of lightweight silk, satin or similar thin, clinging, non or minimally stretchable fabric. It will be appreciated that the back cowl neck outer garment 700, in alternative embodiments, may be made of any similar material now known or later developed.

The back cowl neck outer garment 700 includes two back cowl neck shoulder straps 702-A and 702-B. When the garment is worn, each back cowl neck shoulder strap 702 passes across one or both of the shoulders and attaches to a back cowl neck side seam 736 of the back cowl neck outer garment 700 to support the back cowl neck outer garment 700. As illustrated, the back cowl neck shoulder strap 702-A attaches to the back cowl neck side seam 736-A and the back cowl neck shoulder strap 702-B attaches to the back cowl neck side seam 736-B. It will be appreciated that although two back cowl neck shoulder straps 702 are illustrated, any number of shoulder straps may be implemented in accordance with various embodiments. The back cowl neck shoulder straps 702, in some embodiments are made of the same material as the back cowl neck outer garment 700. Alternatively, the back cowl neck shoulder straps 702 may be made of another material, now known or later developed.

In some embodiments, proximately located with and coupled to each back cowl neck shoulder strap 702 is a back cowl neck slider 706. As illustrated, for example, the back cowl neck slider 706-A is proximately located with and coupled to the back cowl neck shoulder strap 702-A and the back cowl neck slider 706-B is proximately located with the back cowl neck shoulder strap 702-B. Each back cowl neck slider 706 enables adjustment of the length of the associated back cowl neck shoulder strap 702. As is known in the art, each back cowl neck slider 706 may be a ring, slide, hook, or other similar mechanically adjusting apparatus. In some embodiments, each back cowl neck slider 706 is made of stainless steel or other similar metal, or alternatively made of plastic and nylon coated metal and stainless steel. It will be appreciated that any adjusting apparatus of any appropriate material now known or future developed may be used for each of the back cowl neck sliders 706. In alternative embodiments, the back cowl neck outer garment 700 does not include a slider.

In one embodiment, each back cowl neck shoulder strap 702 is attached to a front (not shown) of the back cowl neck outer garment 700 via a shoulder strap front securing means (not shown) similarly to the front securing means 112 illustrated in FIG. 1 for the outer garment 100. It will be appreciated by those of ordinary skill in the art that in one embodiment one or more of the shoulder strap front securing means comprise a permanent attachment such as a sewn, stapled, mechanically attached (for example via a ring) or other permanent attachment. It will further be appreciated that in alternative embodiments one or more of the shoulder strap front securing means comprises a removable attachment such as a VELCRO®, snap, button, or other removable attachment.

As previously mentioned, each back cowl neck shoulder strap 702 attaches to a back cowl neck side seam 736 of the back cowl neck outer garment 700 via a back cowl neck back securing means 708. For example, as illustrated the back cowl neck shoulder strap 702-A attaches to the back cowl neck side seam 736-A of the back cowl neck outer garment 700 via the back cowl neck back securing means 708-A. Similarly, the back cowl neck shoulder strap 702-B attaches to the back cowl neck side seam 736-B of the back cowl neck outer garment 700 via the back cowl neck back securing means 708-B. It will be appreciated by those of ordinary skill in the art that in one embodiment one or more of the back cowl neck back securing means 708 comprises a permanent attachment such as a sewn, stapled, mechanically attached (for example via a ring) or other permanent attachment. It will further be appreciated that in alternative embodiments one or more of the back cowl neck back securing means 708 comprises a removable attachment such as a VELCRO®, snap, button, or other removable attachment.

The back cowl neck back 714 of the back cowl neck outer garment 700, includes one or more cowls 740 falling on the back area. The cowls 740 provide for an open back in which a bralette back portion 742 of an back cowl neck built-in stretch bralette 716 may be visible.

The back cowl neck built-in stretch bralette 716, in accordance with some embodiments, is composed of stretch lace or a similar stretch fabric. Lace is a delicate fabric made of yarn or thread in an open weblike pattern, made by machine or by hand. Stretch fabrics include, but are not limited to, elastane, nylon and elastane combinations, and polyester and elastane combinations.

In some embodiments, the bralette back portion 742 is solely attached to the back cowl neck side seams 736-A and 736-B of the back cowl neck outer garment 700. In alternative embodiments, the bralette back portion 742 of the back cowl neck built-in stretch bralette 716 is attached continuously at a back cowl neck back bottom portion 744 around the back cowl neck back 714 of the back cowl neck outer garment 700. The bralette back portion 742, in some embodiments, is finished or bound with the same or similar material as the back cowl neck outer garment 700. Alternatively, the bralette back portion 742 is finished using elastic covered by a finishing material, which may, in some embodiments, match the material of the back cowl neck outer garment 700. The elastic may be, for example, braided, woven, knitted, or any other elastication means now known or later developed. In alternative embodiments, the bralette back portion 742 does not include elastication means. In alternative embodiments, the bralette back portion 742 does not include elastication means.

The back cowl neck built-in stretch bralette 716, in accordance with some embodiments, includes two bralette shoulder straps 720-A and 720-B. When the garment is worn, each bralette shoulder strap 720 passes across one or both of the shoulders and attaches to a bralette side portion 764 of the back cowl neck built-in stretch bralette 716 to support the back cowl neck built-in stretch bralette 716. It will be appreciated that each bralette side portion 764 (764-A and 764-B) may be the same or proximately located to the back cowl neck side seam 736 (736-A and 736-B) in some embodiments. Alternatively, each bralette side portion 764 may be located differently from the back cowl neck side seams 736. As illustrated, the bralette shoulder strap 720-A attaches to the bralette side portion 764-A and the bralette shoulder strap 720-B attaches to the bralette side portion 764-B. It will be appreciated that although two bralette shoulder straps 720 are illustrated, any number of shoulder straps may be implemented in accordance with various embodiments. The bralette shoulder straps 720, in some embodiments are made of the same material as the back cowl neck outer garment 700. The bralette shoulder straps 720, in other embodiments are made of the same material as the back cowl neck built-in stretch bralette 716. In yet other embodiments, the bralette shoulder straps 720 may be made of another material, now known or later developed.

In some embodiments, proximately located with and coupled to each bralette shoulder strap 720 is a bralette slider 722. As illustrated, for example, the bralette slider 722-A is proximately located with and coupled to the bralette shoulder strap 720-A and the bralette slider 722-B is proximately located with the bralette shoulder strap 720-B. Each bralette slider 722 enables adjustment of the length of the associated bralette shoulder strap 720. As is known in the art, each bralette slider 722 may be a ring, slide, hook, or other similar mechanically adjusting apparatus. In some embodiments, each bralette slider 722 is made of stainless steel or other similar metal, or alternatively made of plastic and nylon coated metal and stainless steel. It will be appreciated that any adjusting apparatus of any appropriate material now known or future developed may be used for each of the bralette sliders 722. In alternative embodiments, the back cowl neck outer garment 700 does not include a bralette slider.

Each bralette shoulder strap 720 is attached to a bralette front (not shown) via a bralette shoulder strap front securing means (not shown). For example, the bralette shoulder strap 720-A attaches to the bralette front of the back cowl neck built-in stretch bralette 716 via a first bralette shoulder strap front securing means (not illustrated). Similarly, the bralette shoulder strap 720-B attaches to the bralette front of the back cowl neck built-in stretch bralette 716 via a second bralette shoulder strap front securing means (not illustrated). It will be appreciated by those of ordinary skill in the art that in one embodiment one or more of the bralette shoulder strap front securing means comprise a permanent attachment such as a sewn, stapled, mechanically attached (for example via a ring) or other permanent attachment. It will further be appreciated that in alternative embodiments one or more of the bralette shoulder strap front securing means comprises a removable attachment such as a VELCRO®, snap, button, or other removable attachment.

As previously mentioned, each bralette shoulder strap 720 attaches to a bralette side portion 764 via a bralette shoulder strap back securing means (not illustrated). In some embodiments, each of the bralette side portion 764 is co-located or proximately located with each of the back cowl neck back securing means 708. It will be appreciated by those of ordinary skill in the art that in one embodiment one or more of the bralette shoulder strap back securing means comprises a permanent attachment such as a sewn, stapled, mechanically attached (for example via a ring) or other permanent attachment. It will further be appreciated that in alternative embodiments one or more of the bralette shoulder strap back securing means comprises a removable attachment such as a VELCRO®, snap, button, or other removable attachment.

In an alternative embodiment, each bralette shoulder strap 720 is attached to a bralette front (not shown) via a bralette shoulder strap front securing means (not shown). Each bralette shoulder strap 720 further is coupled to the associated back cowl neck slider 706 along with the back cowl neck shoulder strap 702. In one embodiment, the bralette shoulder strap 720 terminates at the back cowl neck slider 706. In another embodiment, the back cowl neck shoulder strap 702 terminates at the back cowl neck slider 706. In each of these embodiments, thereafter, one strap continues to and is secured to the back cowl neck side seam 736.

Figure 8:
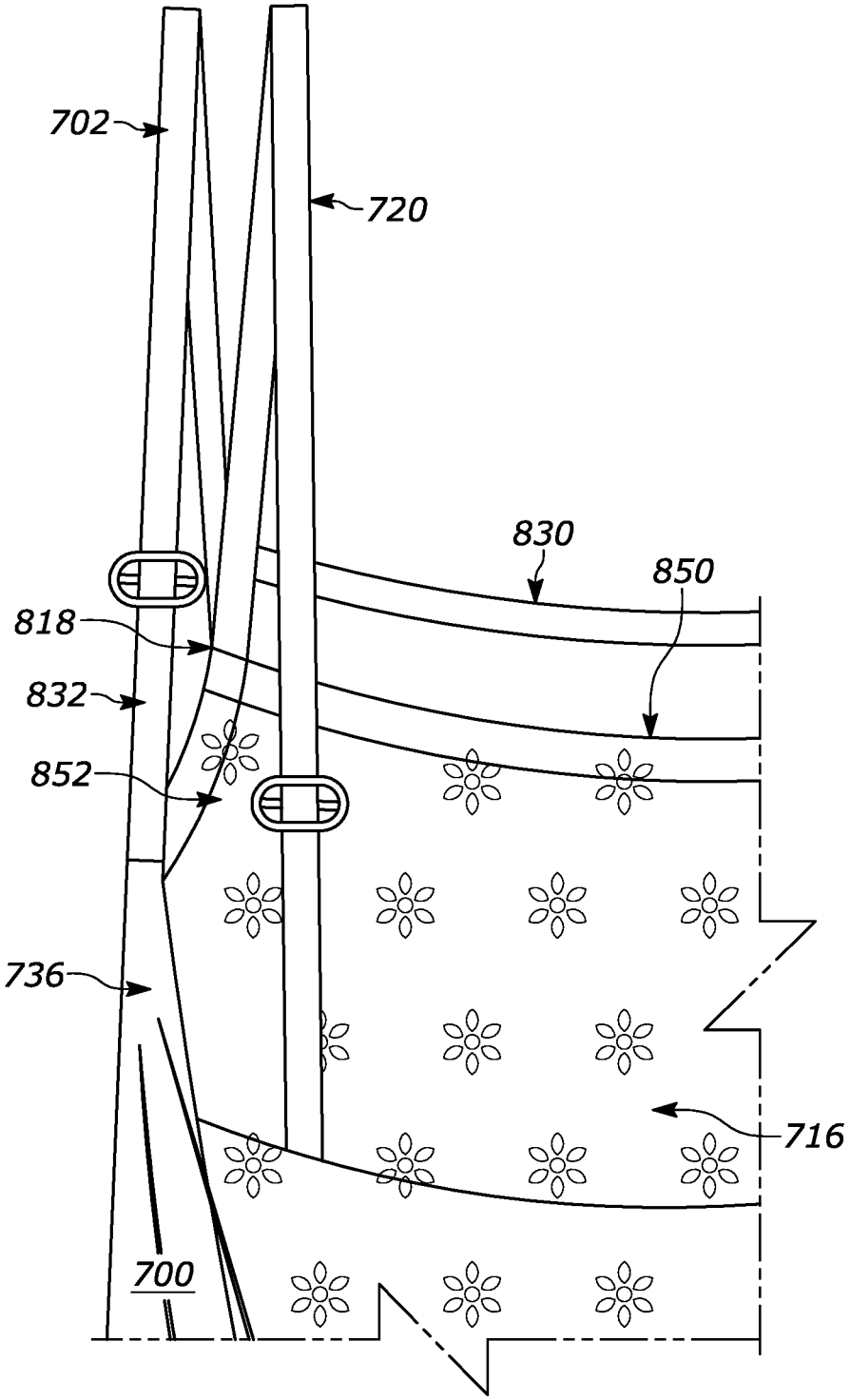
FIG. 8 illustrates a close-up back view of a garment with a built-in stretch bralette in accordance with a second alternative embodiment.

FIG. 8 illustrates a close-up partial back view of the back cowl neck garment of FIG. 7. As illustrated, the back cowl neck built-in stretch bralette 716, in accordance with some embodiments, has a back cowl neck bralette neckline 850 proximately located in parallel to a back cowl neck neckline 830 of the back cowl neck outer garment 700. Further, the back cowl neck built-in stretch bralette 716, in accordance with some embodiments, has two back cowl neck bralette armholes 852 proximately located in parallel to each of the back cowl neck armholes 832 of the back cowl neck outer garment 700.

The back cowl neck built-in stretch bralette 716, in accordance with some embodiments, is independent from the back cowl neck outer garment 700. In accordance with some embodiments, the floating independent back cowl neck built-in stretch bralette 716 includes a finishing along its edges. In some embodiments, the back cowl neck built-in stretch bralette 716 is finished or bound with the same or similar material as the back cowl neck outer garment 700. Alternatively, the back cowl neck built-in stretch bralette 716 is finished using a foldover elastic, which may, in some embodiments, match the material of the back cowl neck outer garment 700. The elastic may be, for example, braided, woven, knitted, or any other elastication means now known or later developed.

In some embodiments, the back cowl neck built-in stretch bralette 716 is attached at a back cowl neck side seam 736 of each side of the back cowl neck outer garment 700, leaving a gap at a back cowl neck neckline 830 plus each of the back cowl neck armhole 832. Taken together, the attachment mechanism leaves a gap at the back cowl neck neckline 830 through each back cowl neck armhole 832.

In alternative embodiments, the back cowl neck built-in stretch bralette 716 is attached at a back cowl neck front base 818 of each of the back cowl neck shoulder straps 702 which optionally may also be a front base of each of the bralette shoulder straps 720. The back cowl neck built-in stretch bralette 716 is further attached at a back cowl neck side seam 736 of each side of the back cowl neck outer garment 700, leaving a gap at a back cowl neck neckline 830 and at each back cowl neck armhole 32. Taken together, the attachment mechanism leaves a gap at the back cowl neck neckline 830 and at each back cowl neck armhole 832.

In some embodiments, back cowl neck built-in stretch bralette 716 includes a finishing at portions that are not attached to the back cowl neck outer garment 700, for example, at the locations of each of the gaps. In some embodiments, the back cowl neck bralette neckline 850 and each of the back cowl neck bralette armholes 852 is finished or bound with the same or similar material as the back cowl neck outer garment 700. Alternatively, the back cowl neck bralette neckline 850 and each of the back cowl neck bralette armholes 852 is finished using a foldover elastic, which may, in some embodiments, match the material of the back cowl neck outer garment 700. The elastic may be, for example, braided, woven, knitted, or any other elastication means now known or later developed.

Each embodiment herein described of the intermittently secured attachment of the back cowl neck built-in stretch bralette 716 to the back cowl neck outer garment 700 eliminates the pulling that would otherwise happen when a stretchable material in a bralette is attached to a non-stretchable silk.

Figure 9:
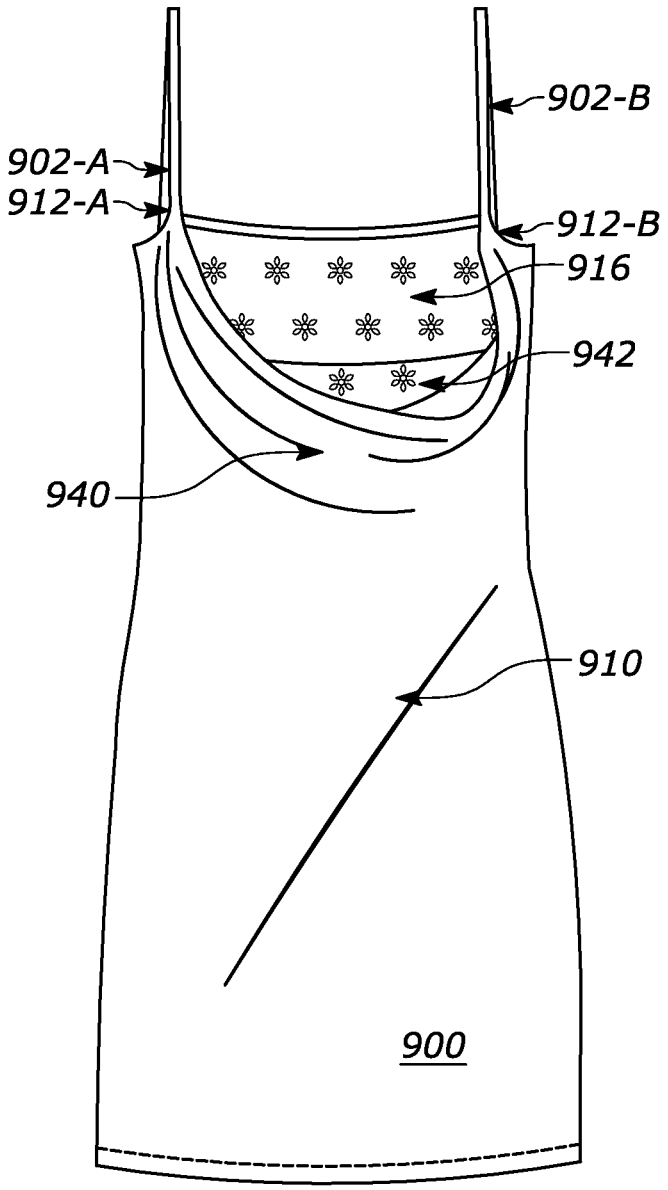
FIG. 9 illustrates a front view of a garment with a built-in stretch bralette in accordance with a third alternative embodiment.

FIG. 9 illustrates a front view of a front cowl neck garment with a front cowl neck built-in stretch bralette 916 in accordance with a third alternative embodiment. The front cowl neck garment includes a front cowl neck outer garment 900, which, for example, may be a camisole, tank top, dress, nightgown, or other similar loungewear. It will be appreciated that the front cowl neck outer garment 900 is simply an illustrative example for clarity of description and that the present invention may be implemented within alternative garments now known or later developed other than illustrated or described herein. The front cowl neck outer garment 900 comprises a front cowl neck dress with a built-in stretch bralette. The term cowl neck refers to a design with a neckline on that hangs in draped folds. The front cowl neck outer garment 900 may be made of lightweight silk, satin or similar thin, clinging, non or minimally stretchable fabric. It will be appreciated that the front cowl neck outer garment 900, in alternative embodiments, may be made of any similar material now known or later developed.

A front cowl neck front 910 of the front cowl neck outer garment 900, includes one or more front cowls 940 falling on the front area. The front cowls 940 provide for an open front in which a bralette front portion 942 of the front cowl neck built-in stretch bralette 916 may be visible.

The front cowl neck built-in stretch bralette 916, in accordance with some embodiments, is composed of stretch lace or a similar stretch fabric. Lace is a delicate fabric made of yarn or thread in an open weblike pattern, made by machine or by hand. Stretch fabrics include, but are not limited to, elastane, nylon and elastane combinations, and polyester and elastane combinations.

The front cowl neck outer garment 900 includes two front cowl neck shoulder straps 902-A and 902-B. It will be appreciated that although two front cowl neck shoulder straps 902 are illustrated, any number of shoulder straps may be implemented in accordance with various embodiments. The front cowl neck shoulder straps 902, in some embodiments are made of the same material as the front cowl neck outer garment 900. Alternatively, the front cowl neck shoulder straps 902 may be made of another material, now known or later developed. Each front cowl neck shoulder strap 902 is attached to a front cowl neck front 910 of the front cowl neck outer garment 900 via a front cowl neck front securing means 912. For example, as illustrated the front cowl neck shoulder strap 902-A attaches to the front cowl neck front 910 of the front cowl neck outer garment 900 via the front cowl neck front securing means 912-A. Similarly, the front cowl neck shoulder strap 902-B attaches to the front cowl neck front 910 of the front cowl neck outer garment 900 via the front cowl neck front securing means 912-B. It will be appreciated by those of ordinary skill in the art that in one embodiment one or more of the front cowl neck front securing means 912 comprises a permanent attachment such as a sewn, stapled, mechanically attached (for example via a ring) or other permanent attachment. It will further be appreciated that in alternative embodiments one or more of the front cowl neck front securing means 912 comprises a removable attachment such as a VELCRO®, snap, button, or other removable attachment.

Figure 10:
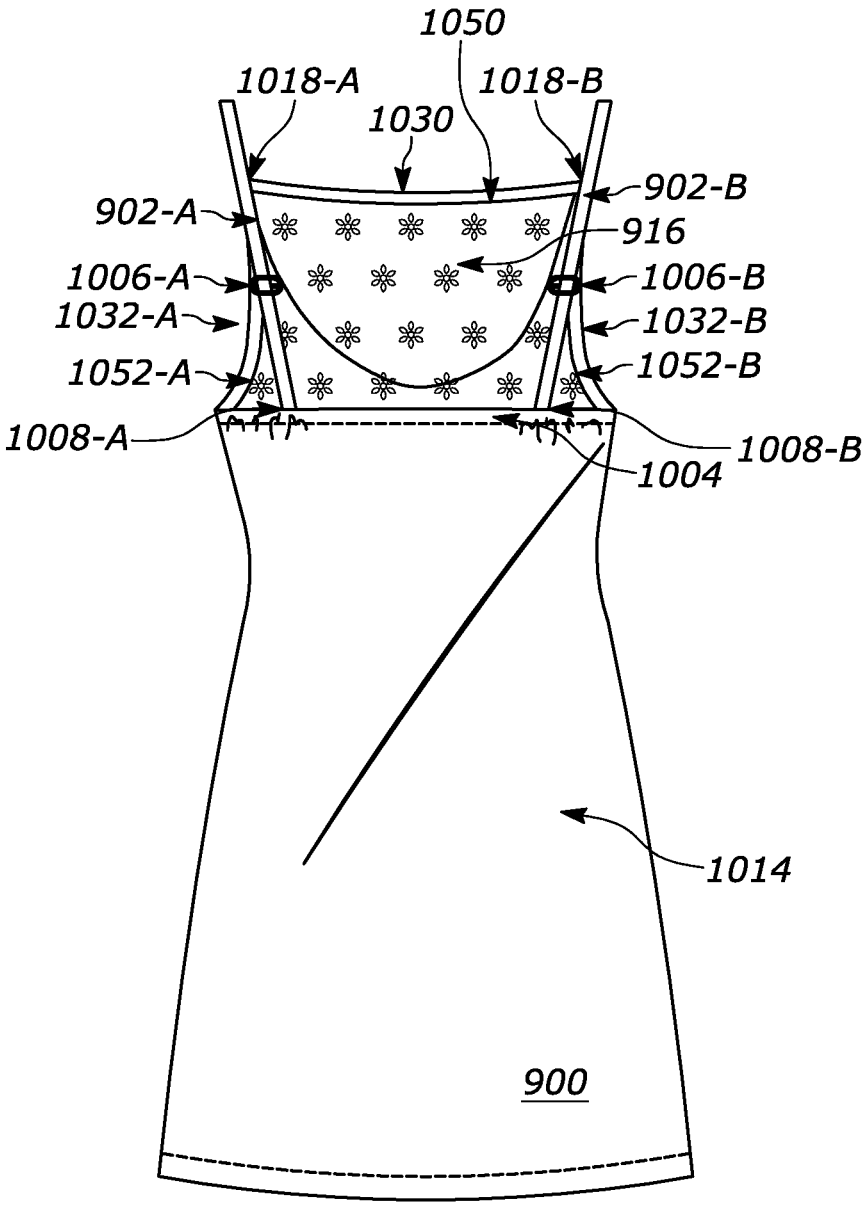
FIG. 10 illustrates a back view of a garment with a built-in stretch bralette in accordance with a third alternative embodiment.

FIG. 10 illustrates a back view of the front cowl neck garment of FIG. 9. As illustrated, when the front cowl neck garment is worn, each front cowl neck shoulder strap 902 passes across one or both of the shoulders and attaches to a front cowl neck back band 1004 of a front cowl neck back 1014 of the front cowl neck outer garment 900 to support the front cowl neck outer garment 900. In some embodiments, proximately located with and coupled to each front cowl neck shoulder strap 902 is a front cowl neck slider 1006. As illustrated, for example, the front cowl neck slider 1006-A is proximately located with and coupled to the front cowl neck shoulder strap 902-A and the front cowl neck slider 1006-B is proximately located with the front cowl neck shoulder strap 902-B. Each front cowl neck slider 1006 enables adjustment of the length of the associated front cowl neck shoulder strap 902. As is known in the art, each front cowl neck slider 1006 may be a ring, slide, hook, or other similar mechanically adjusting apparatus. In some embodiments, each front cowl neck slider 1006 is made of stainless steel or other similar metal, or alternatively made of plastic and nylon coated metal and stainless steel. It will be appreciated that any adjusting apparatus of any appropriate material now known or future developed may be used for each of the front cowl neck slider 1006. In alternative embodiments, the front cowl neck garment outer 900 does not include a slider.

As previously mentioned, each front cowl neck shoulder strap 902 attaches to the front cowl neck back band 1004 of the front cowl neck back 1014 of the front cowl neck outer garment 900 via a front cowl neck back securing means 1008. For example, as illustrated the front cowl neck shoulder strap 902-A attaches to the front cowl neck back band 1004 of the front cowl neck outer garment 900 via the front cowl neck back securing means 1008-A. Similarly, the front cowl neck shoulder strap 902-B attaches to the front cowl neck back band 1004 of the front cowl neck outer garment 900 via the front cowl neck back securing means 1008-B. It will be appreciated by those of ordinary skill in the art that in one embodiment one or more of the front cowl neck back securing means 1008 comprises a permanent attachment such as a sewn, stapled, mechanically attached (for example via a ring) or other permanent attachment. It will further be appreciated that in alternative embodiments one or more of the front cowl neck back securing means 1008 comprises a removable attachment such as a VELCRO®, snap, button, or other removable attachment.

The front cowl neck back band 1004 of the front cowl neck outer garment 900, in some embodiments, is finished or bound with the same or similar material as the front cowl neck outer garment 900. Alternatively, the front cowl neck back band 1004 is finished using elastic covered by a finishing material, which may, in some embodiments, match the material of the front cowl neck outer garment 900. The elastic may be, for example, braided, woven, knitted, or any other elastication means now known or later developed. In alternative embodiments, the front cowl neck back band 1004 of the front cowl neck outer garment 900 does not include elastication means.

The front cowl neck built-in stretch bralette 916, in accordance with some embodiments, is attached to the front cowl neck outer garment 900 using intermittently secured attachment means. The intermittent securing of the front cowl neck built-in stretch bralette 916 allows it to be supportive while not sticking out under the front cowl neck shoulder straps 902. It will be appreciated by those of ordinary skill in the art that in one embodiment the front cowl neck built-in stretch bralette 916 is intermittently permanently attached such as a sewn, stapled, or other permanent attachment. It will further be appreciated that in alternative embodiments the front cowl neck built-in stretch bralette 916 is intermittently removably attached using VELCRO®, snap, button, or other removable attachment.

In some embodiments, the front cowl neck built-in stretch bralette 916 is independent of the front cowl neck front base 1018, and floating in front thereof. In some embodiments, the front cowl neck bralette 916 is solely attached to the front cowl neck side seams (not illustrated) of the front cowl neck outer garment 900. In alternative embodiments, the front cowl neck built-in stretch bralette 916 is further attached at a front cowl neck front base 1018 of each the front cowl neck shoulder straps 902, leaving a gap at a front cowl neck neckline 1030 and at each front cowl neck armhole 1032 (1032-A and 1032-B). In some embodiments, the front cowl neck built-in stretch bralette 916 includes a finishing at portions that are not attached to the front cowl neck outer garment 900, for example, at the locations of each of the gaps. In some embodiments, a front cowl neck bralette neckline 1050 and each of front cowl neck bralette armholes 1052 (1052-A and 1052-B) is finished or bound with the same or similar material as the front cowl neck outer garment 900. Alternatively, the front cowl neck bralette neckline 1050 and each of the bralette armholes 1052 (1052-A and 1052-B) is finished using a foldover elastic, which may, in some embodiments, match the material of the front cowl neck outer garment 900. The elastic may be, for example, braided, woven, knitted, or any other elastication means now known or later developed.

As illustrated, the front cowl neck built-in stretch bralette 916 is attached at a front cowl neck front base 1018-A of the front cowl neck shoulder strap 902-A, and is attached at a front cowl neck front base 1018-B of the front cowl neck shoulder strap 902-B. In one embodiment, the front cowl neck built-in stretch bralette 916 is attached solely at the front base 1018 of each the front cowl neck shoulder straps 902. In another embodiment, the front cowl neck built-in stretch bralette 916 is further attached to the entire front cowl neck back band 1004 of the front cowl neck outer garment 900 (not illustrated). In yet another embodiment, the front cowl neck built-in stretch bralette 916 is alternatively attached proximately to the location of the front cowl neck back securing means 1008 of each shoulder strap at the front cowl neck back band 1004 of the front cowl neck outer garment 900 (not illustrated). For example, the front cowl neck built-in stretch bralette 916 may be also attached proximately to the location of the front cowl neck back securing means 1008-A of the front cowl neck shoulder strap 902-A and also attached proximately to the location of the front cowl neck back securing means 1008-B of the front cowl neck shoulder strap 902-B.

Each embodiment herein described of the intermittently secured attachment of the front cowl neck built-in stretch bralette 916 to the front cowl neck outer garment 900 eliminates the pulling that would otherwise happen when a stretchable material in a bralette is attached to a non-stretchable silk.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element preceded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

I claim:

1. A garment with a built-in stretch bralette comprising:

an outer garment, wherein the outer garment includes a neckline, two armholes, and at least two shoulder straps, each shoulder strap having an associated front base; and the built-in stretch bralette, wherein the built-in stretch bralette is attached to the outer garment using a spaced securement attachment means, wherein the spaced securement attachment means comprises the built-in stretch bralette attached at the front base of each of the shoulder straps and an area under each of the armhole, thereby leaving a gap at the neckline and at each armhole, wherein the built-in stretch bralette includes a finishing at one or more portions that are not attached to the outer garment, at one or more locations of each of the gaps, wherein the finishing comprises binding at the one or more portions, and wherein the finishing comprises one or more of a same material as the outer garment and a fold over elastic.

2. The garment with a built-in stretch bralette of claim 1, wherein the outer garment is made of a fabric comprising one of a stretchable fabric and a non stretchable fabric.

3. The garment with a built-in stretch bralette of claim 2, wherein the fabric comprises at least one of a silk fabric and a satin fabric.

4. The garment with a built-in stretch bralette of claim 1, wherein the built-in stretch bralette is made of a stretch fabric.

5. The garment with a built-in stretch bralette of claim 4, wherein the stretch fabric comprises a stretch lace.

6. The garment with a built-in stretch bralette of claim 1, wherein the spaced securement attachment means comprises a permanent attachment means.

7. The garment with a built-in stretch bralette of claim 1, wherein the spaced securement attachment means comprises a removable attachment means.

8. The garment with a built-in stretch bralette of claim 1, wherein the outer garment further includes a back band; and wherein the spaced securement attachment means further comprises the built-in stretch bralette attached to the back band.

9. The garment with a built-in stretch bralette of claim 1, wherein the outer garment further includes a back band;

wherein each shoulder strap of the outer garment attaches to the back band at a back securing means; and wherein the spaced securement attachment means further comprises the built-in stretch bralette attached to the back band proximate to the back securing means.

10. The garment with a built-in stretch bralette of claim 1, wherein the outer garment comprises a racerback outer garment, wherein the outer garment includes a front having a neckline and two side seams, two armholes, and at least two shoulder straps, each shoulder strap having a front base attached to the front;

wherein the spaced securement attachment means comprises the built-in stretch bralette attached at the front base of each of the shoulder straps, and further attached at each side seam of the front, leaving a gap at the neckline and at each armhole.

11. The garment with a built-in stretch bralette of claim 10, wherein the outer garment further includes a back band; and wherein the secure spaced securement attachment means further comprises the built-in stretch bralette attached to the back band.

12. The garment with a built-in stretch bralette of claim 1, wherein the outer garment comprises a back cowl neck garment, wherein the outer garment includes a back having at least two back side seams; and wherein the spaced securement attachment means comprises the built-in stretch bralette attached to the back side seams.

13. The garment with a built-in stretch bralette of claim 1, wherein the outer garment comprises a back cowl neck garment, wherein the outer garment includes a back including a bottom portion; and wherein the built-in stretch bralette is attached continuously to the bottom portion.

14. The garment with a built-in stretch bralette of claim 12, wherein the outer garment further includes a neckline, two front side seams, and two armholes; and wherein the spaced securement attachment means further comprises the built-in stretch bralette attached at each of the front side seams leaving a gap at the neckline and each of the armholes.

15. The garment with a built-in stretch bralette of claim 1, wherein the outer garment comprises a back cowl neck garment, wherein the outer garment includes a front with a neckline, two side seams, and at least two shoulder straps, each shoulder strap having a front base attached to the front, and wherein the spaced securement attachment means comprises the built-in stretch bralette attached at the front base of each of the shoulder straps and attached at each of the side seams, leaving a gap at the neckline and at each armhole.

16. The garment with a built-in stretch bralette of claim 1, wherein the outer garment comprises a front cowl neck garment, wherein the outer garment includes a neckline, two armholes, two side seams, and at least two shoulder straps, each shoulder strap having a front base, wherein the spaced securement attachment means comprises the built-in stretch bralette attached at each of the side seams and attached at the front base of each the shoulder straps, leaving a gap at the neckline and at each armhole.

17. The garment with a built-in stretch bralette of claim 16, wherein the outer garment further comprises a back having a back band; and wherein the spaced securement attachment means further comprises the built-in stretch bralette attached to the back band.

18. The garment with a built-in stretch bralette of claim 16, wherein each shoulder strap is attached to the back band using a back securing means; and wherein the spaced securement attachment means further comprises the built-in stretch bralette attached proximate to each back securing means.

* * * * *